United States Patent [19]

Webb

[11] Patent Number: 4,790,249

[45] Date of Patent: Dec. 13, 1988

[54] LOAD-CARRYING PALLET

[76] Inventor: H. Richard Webb, 14687 Los Padres, Chesterfield, Mo. 63017

[21] Appl. No.: 50,281

[22] Filed: May 14, 1987

Related U.S. Application Data

[63] Continuation-in-part of Ser. No. 827,861, Feb. 10, 1986, abandoned.

[51] Int. Cl.[4] ..... B65D 9/34

[52] U.S. Cl. ..... 108/51.3; 108/56.1; 206/599

[58] Field of Search ..... 108/51.1, 51.3, 56.1, 108/56.3; 206/386, 599, 600

[56] References Cited

U.S. PATENT DOCUMENTS

| | | | |
|---|---|---|---|
| 2,372,055 | 3/1945 | Braun | 108/51.1 |
| 2,503,240 | 4/1950 | Cahners | 108/51.3 |
| 2,728,545 | 12/1955 | Hermitage | 108/51.3 |
| 3,007,663 | 11/1961 | Huck | 108/51.3 |
| 3,393,646 | 7/1968 | Giacobe | 108/52.1 |
| 3,520,258 | 7/1970 | Shepherd | 108/51.3 |
| 3,666,165 | 5/1972 | Osborne et al. | 108/51.3 X |
| 3,680,494 | 8/1972 | Giasi | 108/51.1 |
| 3,709,161 | 1/1973 | Kauffman | 108/51.1 |
| 3,759,194 | 9/1973 | Fujii et al. | 108/51.1 |
| 3,795,206 | 3/1974 | Utz | 108/51.1 |
| 3,911,834 | 10/1975 | Quaintance | 108/51.3 |
| 3,952,672 | 4/1976 | Gordon et al. | 108/51.3 |
| 4,230,049 | 10/1980 | Horne | 108/51.1 |
| 4,319,530 | 3/1982 | Moog | 108/51.3 |
| 4,467,728 | 8/1984 | Horne | 108/51.1 |

FOREIGN PATENT DOCUMENTS

| | | | |
|---|---|---|---|
| 2820967 | 11/1979 | Fed. Rep. of Germany | 108/51.1 |
| 2260503 | 9/1975 | France | 108/51.3 |
| 967876 | 10/1982 | U.S.S.R. | 108/51.1 |
| 696214 | 8/1953 | United Kingdom | 108/51.1 |

*Primary Examiner*—Kenneth J. Dorner
*Assistant Examiner*—José V. Chen
*Attorney, Agent, or Firm*—Gravely, Lieder & Woodruff

[57] ABSTRACT

A load-carrying pallet includes a rectangular deck and blocks arranged under the deck to provide runners along its side edges. More blocks are located between the runners, yet are spaced from them to support the center portion of the deck, the endmost of these center blocks being located along the end edges of the deck. Between the ends of the center blocks and the runners are entry slots which extend beneath the deck for the full length of the deck for accepting the tines of a forklift at either end of the deck. Moreover, the center blocks are arranged to provide cross channels which are perpendicular to the entry slots, and these channels align with side entry blocks in the runners. The side entry blocks permit the tines of a forklift to enter the cross channels and pass beneath the deck from either side edge of the deck, thus providing the pallet with the capability of four-way entry. Some of the blocks may be formed in an extrusion process from a cellulose material which is bonded together in a tubular configuration by a resin. Others of the blocks may be cut from paperboard honeycomb material.

12 Claims, 4 Drawing Sheets

LOAD-CARRYING PALLET

RELATED APPLICATION

This application is a continuation-in-part of application Ser. No. 827,861 of H. Richard Webb, filed Feb. 10, 1986, now abandoned and entitled LOAD-CARRYING PALLET.

BACKGROUND OF THE INVENTION

This invention relates in general to pallets on which goods are stored and shipped, and more particularly to pallets having supporting components formed from extruded blocks and other relatively inexpensive materials.

The traditional wood pallet for storing and supporting goods has several wood runners to which wood boards are nailed to produce a deck on which the goods are stacked or otherwise placed. The runners, of course, elevate this deck above a floor or some other supporting surface, and this enables the tines of a fork lift to be inserted beneath the deck. With the ever-increasing cost of lumber, wood pallets are relatively expensive and must be used over and over again to justify their cost. This results in the annoying administrative burden of keeping track of pallets, and of course pallets, particularly once they leave the premises of the owner, are more susceptible to loss, pilferage, and damage. Moreover, wood pallets are quite heavy in and of themselves, so a load of wood pallets is not easily transported or handled.

A few pallet manufacturers have substituted less expensive materials either in whole or in part for wood and have produced pallets which by reason of their cost may be used on a disposable or one-trip basis. For example, decks made of corrugated paperboard have been substituted for the traditional boards, while runners formed from paperboard in a honeycomb configuration have taken the place of traditional wood runners. Pallets so formed cost considerably less than the traditional wood pallets. Moreover, such pallets, while having substantial strength in compression, are considerably lighter than wood pallets and thus much easier to handle. A pallet having a corrugated paperboard deck and runners formed from paperboard honeycomb material is disclosed in U.S. Pat. No. 4,319,530.

Even though paperboard honeycomb pallets of the foregoing construction have many advantages over the traditional wood pallets, they do not possess the strength of wood pallets, particularly in shear. In this regard, a pallet which utilizes paperboard honeycomb for its runners, may collapse if shifted laterally over a floor while the honeycomb runners are in contact with the floor, as sometimes occurs when forklift operators try to manipulate the pallets laterally over a floor, this being known as side-shifting. Moreover, the honeycomb material, in order to supply sufficient strength to the pallet, must occupy a proportionately greater area beneath the deck than the wood runners of a conventional wood pallet, and this detracts from the space available for accommodating the tines of a forklift. This in turn requires the forklift operator to exercise greater caution in maneuvering the forklift tines beneath the deck. Furthermore, paperboard runners loose strength when they become wet, and some warehouse floors are damp.

Thus, while pallets with corrugated paperboard decks and paperboard honeycomb runners have many advantages over the traditional wood pallets, they have some disadvantages as well. What is needed is a light weight pallet constructed from inexpensive material, yet possessing substantial strength approaching that of traditional wood pallets.

SUMMARY OF THE INVENTION

One of the principal objects of the present invention is to provide a pallet that is formed from relatively light weight and inexpensive materials, yet is quite strong and is capable of supporting relatively heavy loads. Another object is to provide a pallet of the type stated which is inexpensive and can be used on a disposable or one-trip basis, yet is durable enough to be used on more than one occasion, so that it can be recycled. A further object is to provide a pallet of the type stated which can withstand so-called side-shifting. An additional object is to provide a pallet of the type stated that provides adequate entries for manipulating the tines of a forklift into the pallet from all four sides. Still another object is to provide a pallet in which the paperboard portions are protected from the tines of a forklift. Yet another object is to provide a pallet of the type stated in which the runners are formed at least in part from an extruded cellulose material bonded together with a suitable resin. These and other objects and advantages will become apparent hereinafter.

DESCRIPTION OF THE DRAWINGS

In the accompanying drawings which form part of the specification and wherein like numerals and letters refer to like parts wherever they occur.

DETAILED DESCRIPTION

Figure 1:
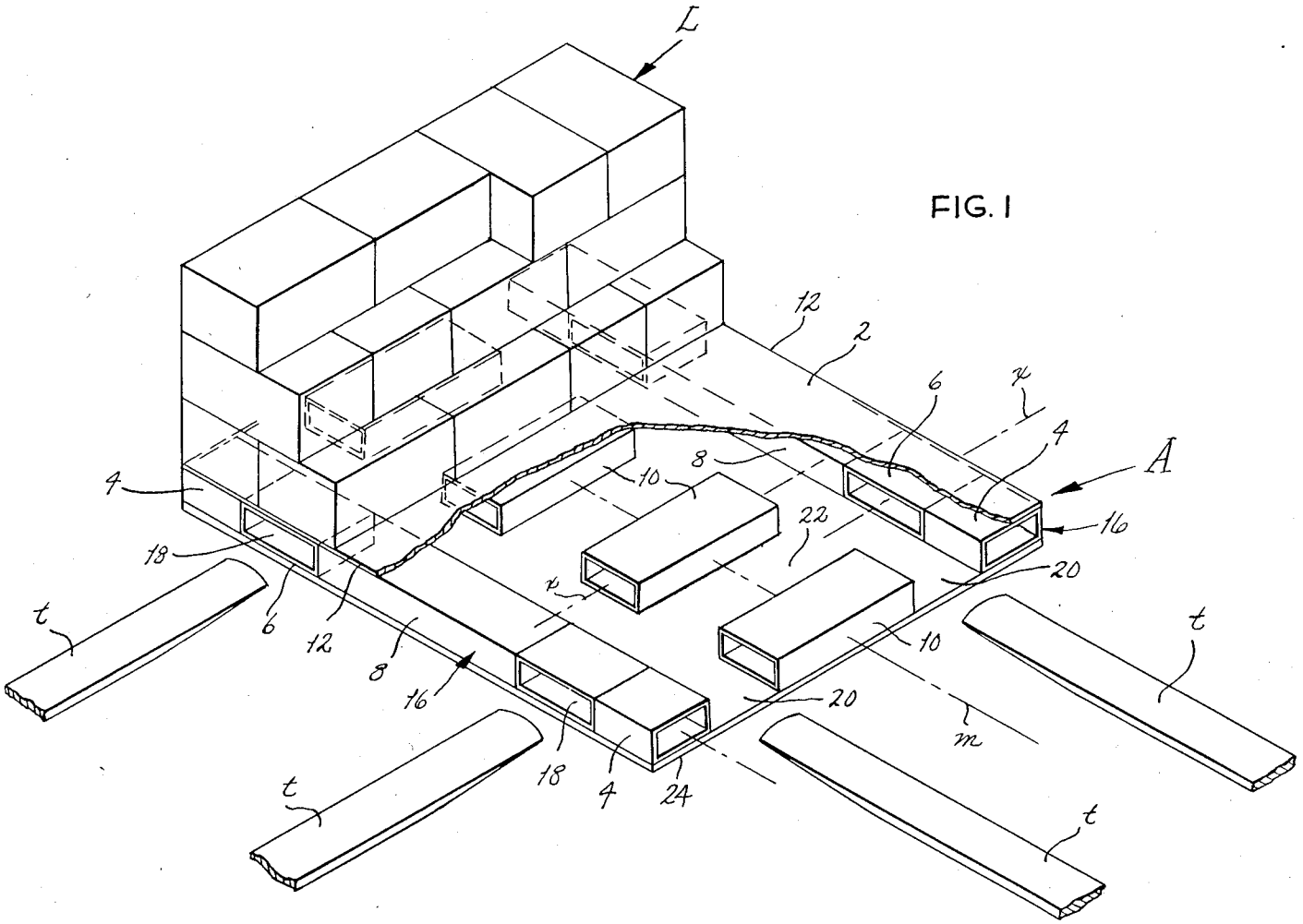
FIG. 1 is a perspective view of a pallet constructed in accordance with and embodying the present invention, that pallet supporting a load and having its deck partially broken away and in section, and further illustrating tines of a forklift aligned with entry slots or channels along the edges of the pallet.

Referring now to the drawings, a pallet A (FIGS. 1 and 2) is designed for supporting a load L slightly above an underlying surface such as the wood or concrete floor of a warehouse or the bed of a truck, yet with enough elevation and open spaces to enable the tines t of a forklift to be maneuvered under the load L, so that the load L may be lifted with the tines t. The pallet A is rectangular in configuration and as such has a longitudinal centerline or axis m. It includes an upper deck 2 and a series of tubular blocks—namely corner blocks 4, side entry blocks 6, intervening blocks 8, and center blocks 10—attached to the underside of the deck 2.

The deck 2 provides a flat and continuous surface that is presented upwardly so that the load may be placed upon it. It is rectangular in configuration, being somewhat longer than it is wide and as such has parallel side edges 12, which are also parallel to the longitudinal axis m, and somewhat shorter parallel end edges 14. A typical deck 2 will measure 40"×48". A wide variety of materials, such as corrugated paperboard, fiberboard, plywood, and honeycomb materials, to name a few, are suitable for use in the deck 2. Where corrugated paperboard forms the deck 2, it is desirable to have the corrugations in more than one layer, with flat layers of paperboard separating the corrugated layers and also forming the top and bottom layers of the deck 2 as well, and with the corrugations of adjacent layers oriented at right angles with respect to each other. Standard corrugated sheet of the foregoing character is available in the market. Irrespective of the material from which the deck 2 is made, it should be light in weight, flat, and continuous, that is without voids or openings.

The blocks 4, 6, 8, and 10 are formed in an extrusion process in which a mixture of a cellulose material and a liquid bonding agent are extruded through a die in a rectangular and tubular configuration. The pressure within the die and extrusion pump behind the die should range between 2000 and 3000 lbs/in$^2$. Suitable cellulose materials are sawdust, shreaded paper and peanut hulls, to name a few which are generally available in the market as waste materials from other processes and therefore are relatively inexpensive. Sawdust is the preferred cellulose material, and perhaps one of the most readily available. Urea formaldehyde is a suitable bonding agent. This resin sets quickly and bonds the sawdust together, providing the extrusion with substantial strength and rigidity. For example, when the block is formed from sawdust and the foregoing resin and measures 2½"×7¾"×24" with a wall thickness of ¼" to ¾", it is capable of supporting 25,000 lbs. Once the resin has set, the density of the extruded material should range from 22 to 60 lbs/ft$^3$ and should preferably be between 40 and 57 lbs/ft$^3$, with the particular density to a large measure depending on the application. Extrusions suitable for providing the blocks 4, 6, 8, and 10 upon being cut are available from Innovative Sales, Inc., of St. Louis, Miss.

In cross-sectional configuration, the corner blocks 2, intervening blocks 8 and center blocks 10, are all the same, and hence may be derived from the same extrusion die. In other words, the extrusions derived from the die are merely cut to different lengths to obtain the blocks 4, 8 and 10. The cross-sectional dimensions for such blocks may be 2½ inches high and 6 inches wide, with a wall thickness of ¼ inches to ⅜ inches. The side entry blocks 6 are somewhat wider, measuring 8 inches in width, but are otherwise the same dimensionally, that is they have the same height and wall thickness as the blocks 4, 8 and 10. The inside corners of all of the extrusions, irrespective of whether they are for the blocks 4, 8 and 10 or the blocks 6, are slightly curved. Being tubular and of rectangular cross-sectional configuration, each blocks 4, 6, 8, and 10 has vertical side walls which are parallel to each other, larger top and bottom walls which are likewise parallel to each other, end faces through which the hollow interior of the block opens, and a longitudinal axis x which passes through the hollow interior parallel to the side, top and bottom walls. The side, top and bottom walls of each block 4, 6, 8, and 10 are solid and quite rigid in the sense that they do not flex easily, as does paperboard. Moreover, their outwardly presented faces are smooth and planar. All of the blocks 4, 6, 8, and 10 along their flat top walls are attached firmly to the underside of the deck 2, preferably by glue, but are otherwise detached from one another and thus do not interlock.

The corner blocks 4, as their name implies, are located at the corners of the deck 2, with their longitudinal axes x parallel to each other and to the longer side edges 12 of the deck 2. Each has one of its solid side walls along one of the longitudinal side edges 12 of the deck 2 and one of its open ends faces at the intersecting end edge 14 of the deck 2. Indeed, the side and end faces of the corner block 4 register with those side and end edges 12 and 14, respectively, of the deck 2 where those edges 12 and 14 intersect to form the corner at which the block 4 is located.

The side entry blocks 6 are oriented with their axes x extended transversely of the deck 2 instead of longitudinally as are the axes of the corner blocks 4. In that direction the side entry blocks 6 are as long as the corner blocks 4 are wide, and that dimension is preferably 6 inches. Each side entry block 6 is set against the deck 2 with one of its open ends faces parallel to and along one of the side edges 12 of the deck 2 and with one of its solid side faces abutting against the inside open end face of the adjacent corner block 4. Thus, the hollow interiors of the side entry blocks 4 are exposed along the longitudinal side edges 12 of the deck 2, and indeed the two blocks 6 along each side edge 14 are spaced to accommodate the tines t on a conventional forklift. Moreover, the hollow interior of each side entry block 6 is large enough to receive, with considerable clearance, both laterally and vertically, the tine t of a forklift.

The intervening blocks 8, although being oriented the same as the corner blocks 4, that is with their axes x parallel to the side edges 12, are considerably longer than the corner blocks 4, and indeed each occupies the space between a pair of the side entry blocks 6 along one of the side edges 12 of the deck 2. Thus, its open end faces abut against the solid side walls on the side entry blocks 6 between which it fits. Like the corner blocks 4 with which they align, each intervening block 8 has one of its solid side faces along one of the longitudinal side edges 12 of the deck 2.

The two corner blocks 4, the two side entry blocks 6 and the single intervening block 8 along each side edge 12 of the deck 2 form a continuous runner 16 along that side edge. The runner 16, while being formed from five blocks 4, 6 and 8, nevertheless presents a continuous surface of uniform width downwardly, and another continuous surface of uniform width upwardly, the latter being against the under surface of the deck 2 where the blocks 4, 6 and 8 are attached to the deck 2 with glue. For the most part each runner 16 presents a solid surface of uniform heighth laterally at the side edge 12 of the deck 2 along which it is located, but that side surface is interrupted at two spaced apart locations by the hollow interiors of the side entry blocks 6. These hollow interiors provide within the runners 16 side entry openings 18 which are capable of accommodating the tines t of a forklift, so that those tines t may be inserted beneath the deck 2 to lift the pallet A and whatever load L that may be upon it. Being along the two longitudinal side edges of the deck 2, the runners 16 support those regions of the deck 2 above an underlying surface such as the floor of a warehouse or the bed of a truck.

The intervening midportion or center region of the deck 2 is, on the other hand, supported by the center blocks 10 which are spread apart along that region. The center blocks 10 have their axes x oriented transversely with respect to the deck 2, that is parallel to the end edges 14, so that the open end faces of those blocks 10 are presented toward the runners 16. Nevertheless, the blocks 10 are considerably shorter than the spacing between the two runners 16. Actually, the blocks 10 are centered with respect to the centerline m of the pallet A, so that a space exists between the open end of each block 10 and the runner 16 toward which that end is presented. That space forms an entry slot 20 which is wide enough to accommodate the tine t of a forklift. The two endmost center blocks 10 each have one of their solid side walls along an end edge of the deck 2. As a consequence, the endmost blocks 10 extend no further inwardly than do the square corner blocks 6. In other words, the inwardly presented side walls of the two endmost blocks 10 lie in the plane formed by the interfaces between the corner blocks 4 and the abutting side entry blocks 6. While usually only two more center blocks 10 are necessary to adequately support the deck 2, that number may increase with longer decks. In any event, the next two center blocks 10 are equal in length to the endmost center blocks 10 and are likewise centered with respect to the centerline m of the pallet A, so that the entry slots 20 continue past their ends as well. The outwardly presented side walls of the inner center blocks 10 lie in the same planes as the interfaces between the entry blocks 6 and the abutting intervening blocks 8, producing between each endmost center block 10 and the center block 10 next inwardly from it a cross channel 22 which aligns with the side entry openings 10, that is the hollow interiors of the two side entry blocks 6 at its ends. The channels 22 are thus slightly wider than the side openings 18, and of course are large enough to likewise accommodate the tines t of a forklift. The innermost center blocks 10 are also separated.

Figure 2:
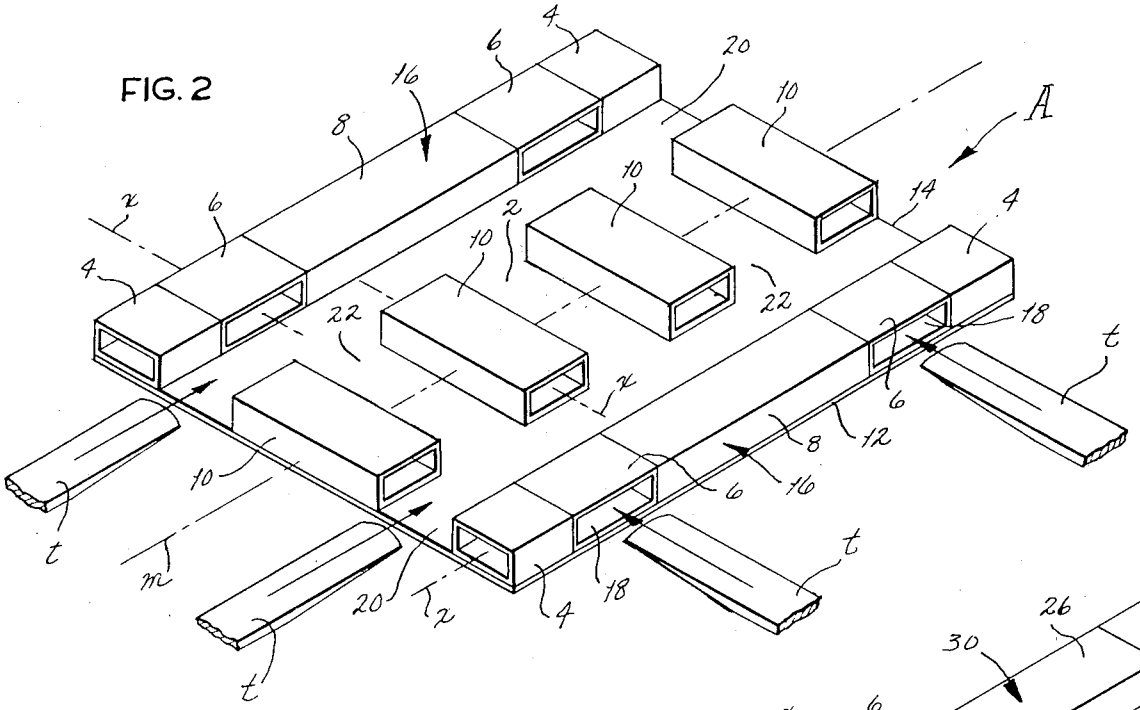
FIG. 2 is a perspective view of the pallet turned upside down with its lower deck removed to show the location and orientation of its tubular blocks.

The pallet A may rest on a supporting surface with the large bottom walls of its blocks 4, 6, 8, and 10 against that surface or it may rest on a lower deck 24 which is identical to the upper deck 2, except that it is joined to the bottom walls of the blocks 4, 6, 8, and 10, again preferably by glue. Of course, the load L is placed on the upwardly presented surface of the upper deck 2 (FIG. 1). The arrangement of the blocks 4, 6, 8, and 10 provides sufficient support under the deck 2 to enable the deck 2 to carry loads of considerable magnitude, yet leaves enough space for the tines t of a forklift to be inserted under the deck 2 from any of the four edges 12 and 14 of the deck 2. In this regard, the two entry slots 20 extend the full length of the deck 2 and open out of the pallet A at the two end edges 14 of the deck 2. In normal practice the tines t of the forklift are inserted into the slots 20 from one end of the pallet A or the other and are advanced through the slots 20 for substantially their full length. Of course, when the tines t are elevated, the pallet A and the load L supported on its deck 2 rises with them. Sometimes the tines t of the forklift are inserted into the pallet A through the side opening 18 in the side entry blocks 6 along one of the side edges 12 of the deck 2. In so doing, the tines t pass through the hollow interiors in those side entry blocks 6 and thence into the cross channels 22. Indeed, they could well pass through the channels 22 into the hollow interiors of the side entry blocks 6 along the other side edge 12 of the deck 2.

While side-shifting, that is using the forklift to shift a pallet over a floor while the pallet remains in contact with the floor, will cause the runners of pallets formed from materials of lesser strength to collapse, the blocks 4, 6, 8, and 10 can withstand the usual side-shifting without collapse or significant deterioration. Moreover, the blocks 4, 6, 8, and 10 are not weakened by moisture, and thus can be used on damp floors.

Figure 3:
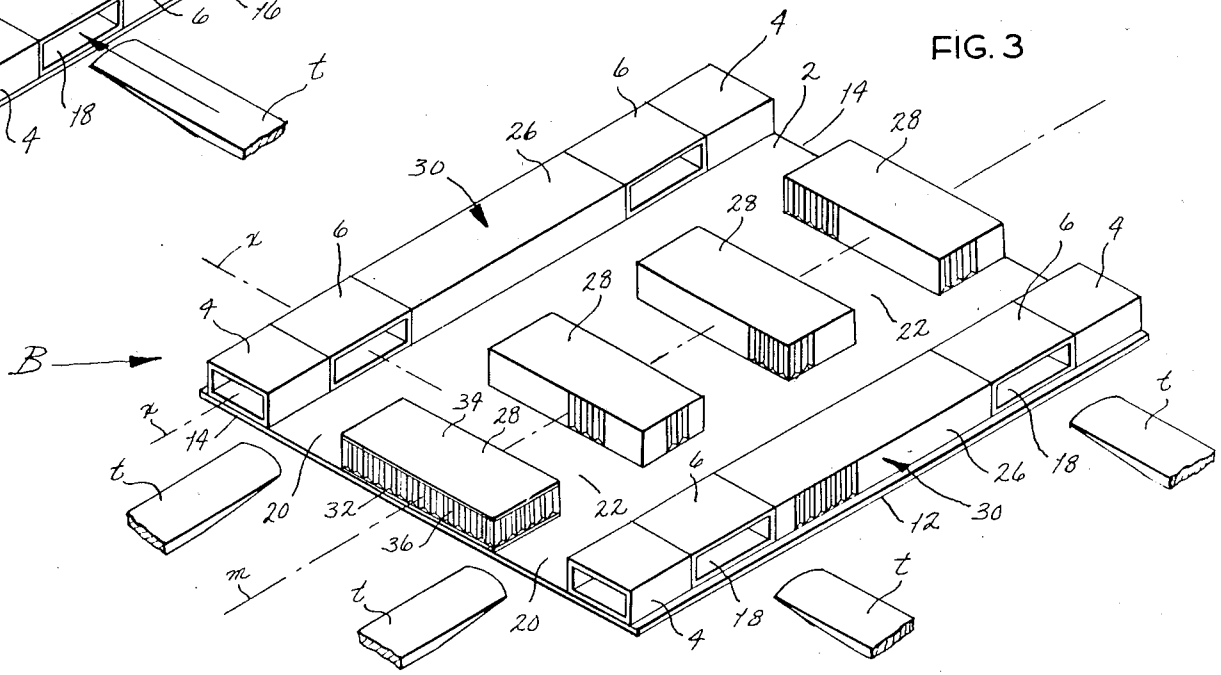
FIG. 3 is a perspective view of a modified pallet turned upside down.

A modified pallet B (FIG. 3) is quite similar to the pallet A in that it has a deck 2 as well as corner blocks 4 and side entry blocks 6 which are tubular extrusions comprised primarily of cellulose material. However, in lieu of the intervening blocks 8, the pallet B has intervening blocks 26, that are formed from paperboard of honeycomb construction so that the resulting runners 30 possess a composite construction. Moreover, the tubular center blocks 10 are replaced with center blocks 28 that are also formed from paperboard of honeycomb construction. Being paperboard honeycomb, each block 26 and 28 includes spaced apart facer sheets 32 and 34 and an array of honeycomb cells 36 interposed between and glued to the facer sheets 32 and 34 with the longitudinal axes of the cells 36 being perpendicular to the facer sheets 32 and 34, the longitudinal axis of any cell of course being a line extending through its hollow interior parallel to its side walls. The honeycomb material from which the blocks 26 and 28 are cut is available in the market and is disclosed in greater detail in U.S. Pat. 4,319,530. The honeycomb intervening and center blocks 26 and 28 possess the same external dimensions as the extruded intervening and center blocks 8 and 10 that they replace, and are furthermore attached to the underside of the deck 2 along their upper facer sheets 32, preferably by glue, at the same locations.

While the extruded corner and side entry blocks 4 and 6 possess more strength per unit area than the honeycomb intervening and center blocks 26 and 28, the intervening and center blocks 26 and 28 with the axes of their honeycomb cells 36 being perpendicular to the deck 2, possess substantial strength in compression, at least for the loads consigned to the pallet B, and furthermore are less expensive than the extruded blocks 8 and 10 that they replace. Nevertheless, the extruded blocks 4 and 6 are at the corners of the deck 2 where the pallet B is subject to the greatest abuse, the extruded material being better able to withstand such abuse than honeycomb material. Furthermore, the presence of the firm extruded blocks 4 and 6 at the corners 6 of the deck 2 enables the pallet B to withstand side-shifting.

To further increase the strength and rigidity of the pallet B, the two endmost center blocks 28, which are formed from honeycomb material, may be replaced with extruded end blocks 10. With this modification the region of the deck 2 along its centerline m is supported by both extruded center blocks 10 and honeycomb center blocks 28. Also, the pallet B may be provided with a lower deck 24.

Figure 4:
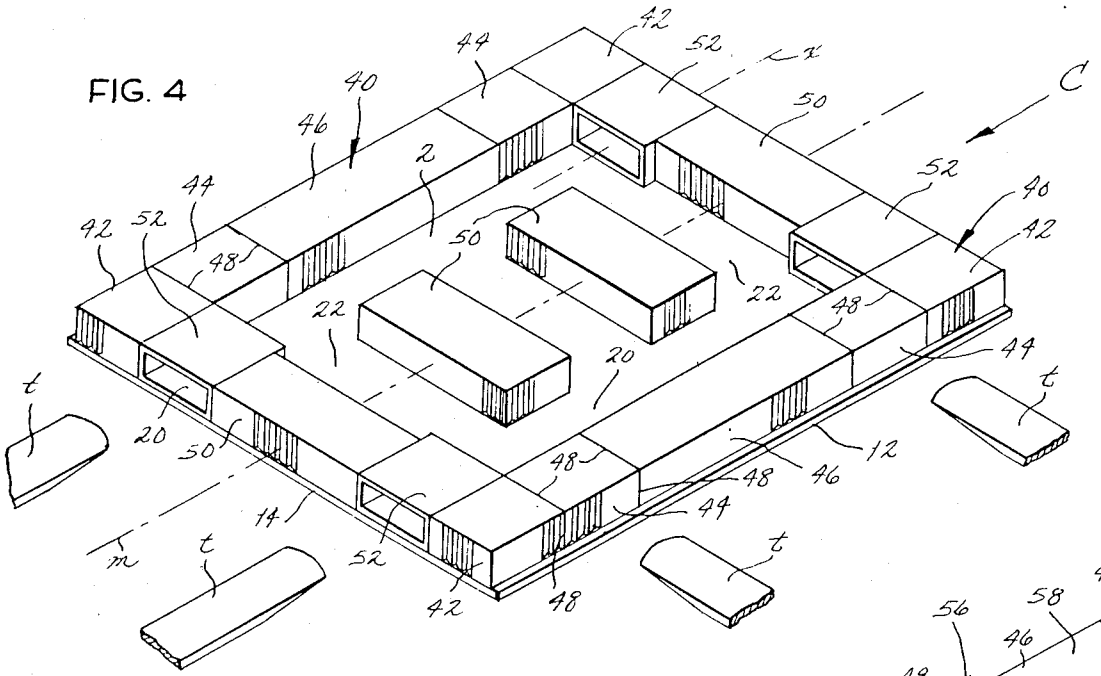
FIG. 4 is a perspective view of another modified pallet turned upside down.

Another modified pallet C (FIG. 4) utilizes mostly honeycomb material to support its deck 2, but extruded blocks are provided at certain locations to impart greater strength and to enable the pallet C to better withstand side-shifting. In particular, the pallet C has runners 40 along each of the side edges 12 of its deck 2, and these runners are in terms of size identical to the runners 16 of the pallet A. However, in lieu of being formed from the extruded blocks 4, 6 and 8 as are the runners 16, each of the runners 40 constitutes a single block of honeycomb material. This block is slit through both of its lower face sheets 34 and into its cells 36 along cuts 48 that extend all the way to the upper facer sheet 32 so as to divide the runner 40 into several sub-blocks or sections, namely, two corner sections 42, two side entry sections 44 and a single intervening section 46 which correspond in size and location to the corner blocks 4, side entry blocks 6 and intervening blocks 8, respectively, of the runners 12. Each runner 40 is attached to the deck 2 by glue along the upper facer sheet 32 for the runner 40, except at the side entry sections 44.

In addition, the pallet C has four center blocks 50 which generally correspond in size and location to the center blocks 10 of the pallet A, but like the runners 40 are made from honeycomb material. The spaces between the endmost center block 50 and the center block immediately inwardly from them constitute the cross channels 22 for the pallet C, and these channels align with the side entry sections 44 on runners 40 at that end of the center blocks 50 and the runners 40 constitute the entry slots 20 for the pallet C.

The ends of the two entry slots 20 are occupied by entry blocks 52 which are tubular in construction and, like the blocks 4, 6, 8, and 10, constitute primarily a cellulose material that is extruded into the tubular configuration. The blocks 52 have their axes x aligned with the longitudinal axes of the entry slots 20 so that their hollow interiors merely form continuations of the slots 20. While the outer end faces of the blocks 52 lie along the end edges of the deck 2, the inner end faces are located no further inwardly than planes defined by the endmost cuts 48 through the runners 40. Thus, the side entry sections 44 of the runners 40 may be dislodged and displaced inwardly into the cross channels 22 without interference from the end entry blocks 52 or the center blocks 50.

To lift and move the pallet C, the tines t of a forklift are usually inserted through the end entry blocks 52 and advanced through the entry slots 20, generally as far as possible. Then the tines t are elevated. However, if the slots 20 are not accessible by reason of the end entry blocks 52 being obscured, the tines t may be inserted beneath the deck 2 from the sides of the pallet C, this being achieved by bringing the ends of the tines t against the side entry sections 44 along one of the runners 40 and forcing the tines t against those sections. By reason of the cuts 48, the side entry sections 44 break loose from the remainder of the runner 40 and pass through the cross channels 22 ahead of the tines t. The dislodged side entry sections 44 eventually come against the side entry sections 44 on the other runner 40 and dislodge them as well, enabling the tines t to pass completely under the deck 2 within the confines of the cross channels 22.

The honeycomb runners 40 and honeycomb center blocks 50 enable the pallet C to carry a load of considerable magnitude. The end blocks 52 enhance this load-carrying ability and further permit side-shifting of the pallet C. They also isolate the tines t of a forklift from the nearby honeycomb material of the endmost center blocks 50 and the corner sections 42 of the runners 40, thus preventing damage to the center blocks 50 and corner sections 42 upon advancement of the tines t into the pallet C.

The pallet C may also be supplied with a lower deck 24 which is preferably attached by glue to the lower facer sheets 34 of the runners 40, except at the side entry sections 44, and the facer sheets 34 of the center blocks 50, as well as to the bottom walls of the entry blocks 52.

Figure 5:
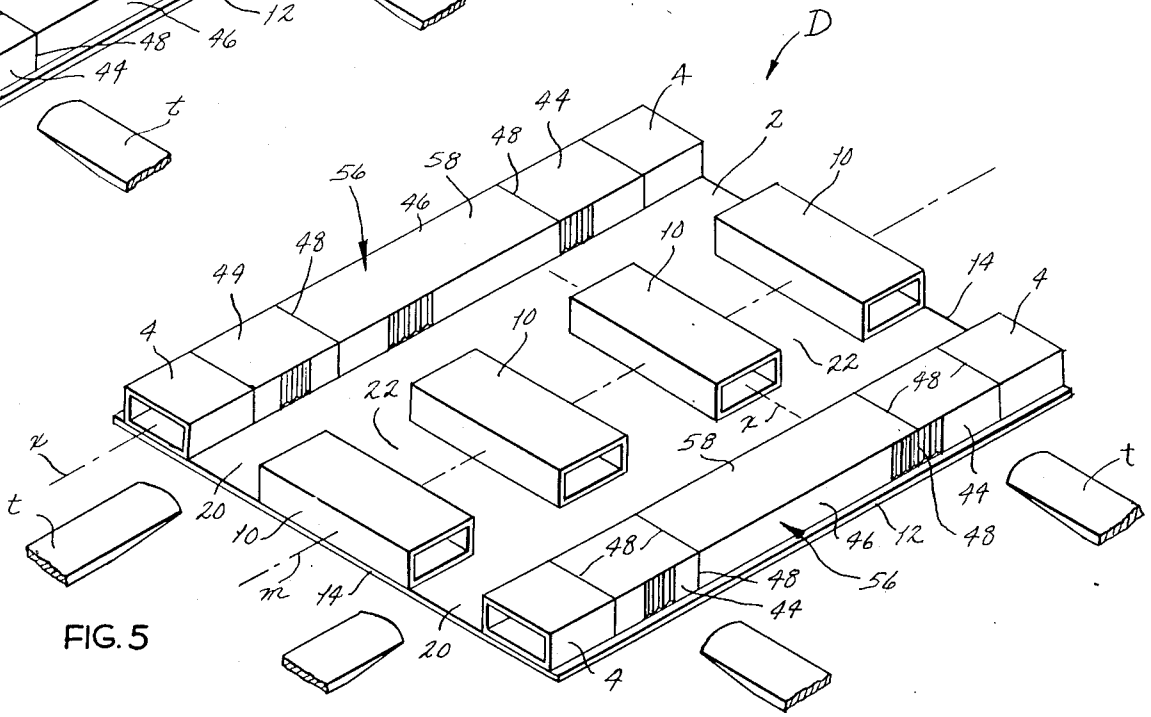
FIG. 5 is a perspective view of still another modified pallet turned upside down.

Still other combinations of honeycomb and extruded blocks are possible. For example, a pallet D (FIG. 5) has runners 56 composed of extruded corner blocks 4 at the corners of its deck 2 and a block 58 of honeycomb material along each side edge 12 between the corner blocks 4 at that side edge. Each honeycomb block 58, in turn, has side entry sections or sub-blocks 44 at its ends and intervening sections or sub-blocks 46 between the side entry sections 44, the sections 44 and 46 being partially connected at cuts 48. The honeycomb blocks 58 abut the extruded corner blocks 4 at the ends of their side entry sections 44, but are attached to the deck only along their intervening sections 46.

The pallet D also has extruded center blocks 10 which are arranged to provide entry slots 20 and cross channels 22 as in the pallet A. The cross channels 22 align with the side entry sections 44 of the honeycomb block 58 and receive those sections when they are displaced by the tines t of a forklift.

Figure 6:
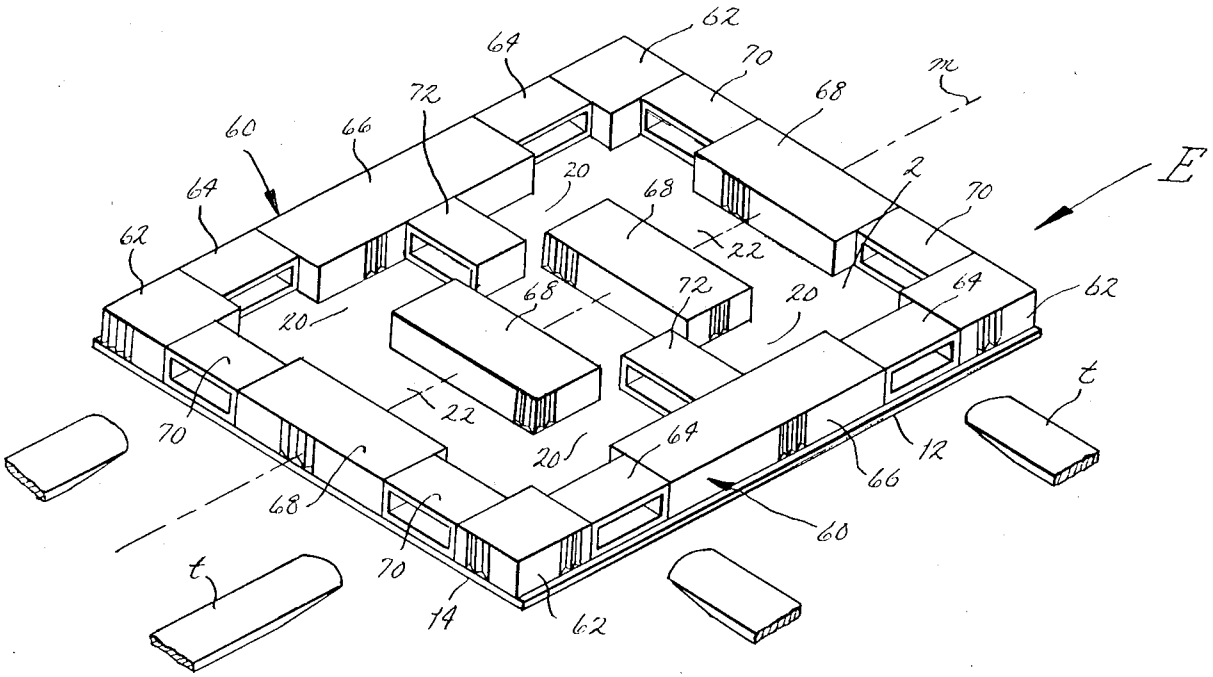
FIG. 6 is a perspective view of yet another modified pallet turned upside down.

The pallet D functions much like the pallet C, only it can support greater loads and sustain more side-shifting by reason of the greater number of extruded blocks, as opposed to honeycomb blocks, namely the corner blocks 4 and the center blocks 10.

Where some of the blocks which support the deck 2 are formed from honeycomb or some other soft material it is possible to protect those soft blocks from the tines of the forklift with harder and more rigid extruded blocks similar to the blocks 4, 6 and 10. For example, still another pallet E (FIG. 6) has runners 60 comprised of honeycomb corner blocks 62, extruded side entry blocks 64 and honeycomb intervening blocks 66, all of which at their upwardly presented faces are attached to the underside of the deck 2 along the side edges 12 of the deck 2. The two side entry sections 64, which are produced in the same manner as the blocks 4, 6, 8, and 10 of the pallet A, are interposed between the corner sections 62 and the intervening blocks 66, so that they are set inwardly from the end edges 14 of the deck 2. Moreover, the hollow interiors of the side entry sections 64 open laterally to provide side openings along the side edges 12 of the deck 2. The midportion of the deck 2, that is the portion along the longitudinal centerline m, receives support from four honeycomb center blocks 68, the two end blocks 68 being along the end edges 12 and the two inner blocks 68 being spaced from the end blocks 68 to provide cross channels 22 which align with the opening in the side entry blocks 64 of the runners 60, all much the same as on the pallet B.

The honeycomb center blocks 68 are furthermore spaced from the two runners 60, there being entry slots 20 along the inside faces of the runners 60 and the ends of the center blocks 68. The ends of the slots 20 are occupied by extruded end entry blocks 70, the hollow interiors of which open outwardly along the end edge 14 of the deck 2, much the same as on the pallet C. The end entry blocks 70 are also produced in the same manner as the extruded blocks 4, 6, 8, and 10 of the pallet A.

In addition, the pallet E may have intermediate guide blocks 72 which are the same size and shape as the end entry blocks 70 and are likewise extruded in the same manner, except that the guide blocks 72 are located in the entry slots 20 midway between the ends of those slots. Like the end entry blocks 52, the guide blocks 62 have their hollow interiors opening into the entry slots 20. One side of each guide block 72 lies along the runner 60 that borders the entry slot 20 in which it is located, while the other side is presented toward the space between the inner two of the four center blocks 68. The guide block 72 however may be omitted.

The tines t of a forklift may be inserted beneath the pallet E at either end, in which case they pass through the end entry blocks 70 and into the entry slots 20, or the tines t may be inserted at either side, where they enter through the side entry blocks 64 and pass through the cross channels 22. The former is preferred, and indeed the entry slots 20 are generally used. When the tines t pass through the entry slots 20, they will encounter the guide blocks 72, if they are present, and indeed pass through them. The guide blocks 72, being formed from the rigid extruded material, prevent the tines t from cutting into and thereby weakening the honeycomb material of the intervening blocks 66 and the center blocks 68 along the entry slots 20, should the tines t become somewhat misaligned with respect to the entry slots 20.

Still other combinations of extruded and honeycomb blocks are available, and the particular combination that is used will to a large measure depend on the magnitude and nature of the load. For example, the guide blocks 72 of the pallet E may be incorporated into any one of the pallets A, B, C, or D. Furthermore, each of the pallets B, C, D, and E, like the pallet A, may have a lower deck 24 so that the tubular and honeycomb blocks are interposed between two decks 2 and 24.

This invention is intended to cover all changes and modifications of the example of the invention herein chosen for purposes of the disclosure which do not constitute departures from the spirit and scope of the invention.

What is claimed is:

1. A load-carrying pallet comprising: a rectangular deck having parallel side edges and parallel end edges which meet at corners; corner, side entry and intervening blocks arranged in a row along each side edge of the deck to form runners along those edges, there being for each runner two corner blocks which are attached to the deck beneath the corners along one of the side edges of the deck, two side entry blocks which are located adjacent the corner blocks along the same side edge and permit the tines of a forklift to pass through the runner and under the deck where such blocks are located, and an intervening block attached to the deck between the side entry blocks, so as to likewise be along the same side edge; center blocks attached to the deck between the two runners and being spaced from the runners such that entry slots exist between the runners and the center blocks, with the entry slots extending from one end edge of the deck to the other end edge, there being a different center block along each end edge of the deck and at least one additional center block spaced from the center blocks that are along the end edges so as to provide cross channels which align with the side entry blocks for the runners and are generally perpendicular to the entry slots; and separate end entry blocks located at the ends of the entry slots where they are along the end edges of the deck, each end entry block being in a tubular configuration with rigid walls that are joined integrally together to surround a hollow interior which opens out of each end of the block, the walls of each entry block being formed from particles or segments of cellulose material and a bonding agent which joins the particles or segments together firmly to provide the walls and the entry blocks which they form with substantial strength and rigidity, the walls having a density of at least 22 lbs/ft$^3$, the rigid tubular end entry blocks being oriented such that their hollow interiors open outwardly of the pallet along the end edges of the pallet so as to form portions of the entry slots, whereby the end entry blocks line the ends of the entry slots and protect the corner blocks of the runners and the center blocks that are located along the end edges; all of the blocks being substantially the same height, at least the corner blocks of the runners or the center blocks that are along the end edges being formed from paper honeycomb material having cells oriented such that the axes of those cells are generally perpendicular to the deck.

2. A pallet according to claim 1 wherein at least some of the blocks aside from the end entry blocks are formed in a tubular configuration from a substantially rigid substance and have generally hollow interiors.

3. A pallet according to claim 2 wherein each rigid tubular block has an axis that is generally parallel to its walls and parallel to the overlying deck.

4. A pallet according to claim 1 wherein those blocks which are not rigid and tubular are formed from a paper honeycomb material.

5. A pallet according to claim 1 wherein the side entry blocks are rigid and tubular and are formed from particles or segments of cellulose material and a bonding agent which joins the particles or segments together, the side entry blocks having axes that lie parallel to their walls and to the cross channels, so that the hollow interiors of the rigid tubular side entry blocks open outwardly along the side edges of the deck.

6. The pallet according to claim 1 wherein the end entry blocks are extrusions derived from extruding a mixture of the particles or segments of cellulose material and the bonding agent through a die with the bonding agent being in a liquid condition and allowing the bonding agent to set.

7. A load-carrying pallet comprising: a substantially rectangular first deck having generally parallel end edges and generally parallel side edges, with the side and end edges meeting at corners; runners attached to the bottom of the deck along the side edges of the deck and terminating at the corners, the runners being formed at least in part from blocks of paperboard honeycomb material having cells oriented such that the axes of those cells are generally perpendicular to the deck; center blocks attached to the bottom of the deck between the runners and being spaced from the runners so that two entry slots extend from one end edge of the deck to the other end edge between the runners and the center blocks, there being a center block along each end edge of the deck; and end entry blocks located beneath the deck at the ends of each entry slot, each end entry block being formed in a tubular configuration with rigid walls, including side walls, that are joined integrally together to surround a hollow interior, the walls of each end entry block being formed from particles or segments of cellulose material and a resin bonding agent which joins the particles or segments together firmly to provide the walls with substantial strength and rigidity, the walls having a density of at least 22 lbs/ft$^3$, the end entry blocks being oriented such that their hollow interiors open outwardly along the end edges of the deck and form portions of the entry slots with their side walls being along the sides of the entry slots, whereby the rigid walls of the end entry blocks line the ends of the entry slots so that the side walls of those blocks protect the center blocks and the portions of the runners that are at the ends of the entry slots, all of the blocks being substantially the same height.

8. A pallet according to claim 7 wherein the center blocks that are located adjacent to the end entry blocks and the portions of the runners that are adjacent to the end entry blocks are formed from paperboard honeycomb material having cells oriented such that the axes of those cells are perpendicular to the deck.

9. A pallet according to claim 7 and further comprising a rectangular second deck spaced from the first deck and also attached to the runners such that the runners are interposed between the first and second decks.

10. The pallet according to claim 7 wherein the end entry blocks are extrusions derived from extruding a mixture of the particles or segments of cellulose material and the bonding agent through a die with the bonding agent being in a liquid condition and allowing the bonding agent to set.

11. A load-carrying pallet comprising: a substantially rectangular deck having generally parallel end edges and generally parallel side edges, with the side and end edges meeting at corners; runners attached to the bottom of the deck and terminating generally at the corners; center blocks attached to the bottom of the deck between the runners and being spaced from the runners so that two entry slots extend from one end edge of the deck to the other end edge between the runners and the center blocks, there being a center block along each end edge of the deck; and end entry blocks located beneath the deck at the ends of each entry slot, each end entry block having rigid side walls and rigid connecting means extended between the side walls such that the block has a generally hollow interior that is capable of receiving the tine of a forklift, the side walls and connecting means of each end entry block being joined together as a rigid integral unit, the end entry blocks being oriented such that their hollow interiors open outwardly along the end edges of the deck and form portions of the entry slots, whereby the rigid side walls of the end entry blocks line the ends of the entry slots, so that the side walls of those blocks protect the center blocks and the portions of the runners that are at the ends of the entry slots; the runners, center blocks, and end entry blocks being of substantially the same height; at least the runners in the regions of the end entry blocks or the center blocks in the regions of the end entry blocks being formed from paperboard honeycomb material having cells oriented such that the axes of those cells are generally perpendicular to the deck; the end entry blocks being formed from particles or segments of cellulose material and a resin bonding agent which joins the particles or segments firmly together to provide a unitary structure in which the walls and connecting means have substantial strength and rigidity, the walls and connecting means having a density of at least 22 lbs/ft$^3$.

12. A pallet according to claim 11 wherein the runners and the center blocks adjacent to the end entry blocks are formed from paperboard honeycomb material having cells oriented such that their axes are perpendicular to the deck.

* * * * *